United States Patent [19]

Kemp

[11] Patent Number: 5,050,887

[45] Date of Patent: Sep. 24, 1991

[54] TRAFFIC SIMULATION BOARD GAME APPARATUS

[76] Inventor: Douglas W. Kemp, 143B Apt. C, Rte. 125, Dover, N.H. 03820

[21] Appl. No.: 622,978

[22] Filed: Dec. 5, 1990

[51] Int. Cl.[5] ..... A63F 3/00

[52] U.S. Cl. ..... 273/237; 273/252; 273/138 A

[58] Field of Search ..... 273/252, 251, 254, 256, 273/243, 237, 148 R, 138 A

[56] References Cited

U.S. PATENT DOCUMENTS

| | | | |
|---|---|---|---|
| 1,652,851 | 12/1927 | Bendtin | 273/251 |
| 2,693,961 | 11/1954 | Ripley | 273/256 |
| 4,863,165 | 9/1989 | Maranzano | 273/237 |

FOREIGN PATENT DOCUMENTS

| | | | |
|---|---|---|---|
| 2537594 | 8/1977 | Fed. Rep. of Germany | 273/138 A |
| 3238373 | 4/1984 | Fed. Rep. of Germany | 273/138 A |

*Primary Examiner*—Benjamin Layno
*Attorney, Agent, or Firm*—Leon Gilden

[57] ABSTRACT

An apparatus including a game board with a lattice-work of intersecting highway paths, with the highway paths including intersecting portions defined by an intersection of each of the paths, wherein the intersection portions include off and on ramps, where each of the highway paths include a spaced plurality of apertured pathways to receive dowels from associated player tokens. The tokens are directed to proceed along the apertured pathways by a directional controlling unit. The directional controlling unit includes sequentially and randomly illuminated light members to indicate whether a player token is to proceed. Each player must culminate movement within a time frame by an associated time clock, with game cards and dice utilized to create obstacles and assess penalties and damages and the like upon players who create accidents or other mistakes of judgment resulting in a lack of progress during a predetermined time internal.

4 Claims, 3 Drawing Sheets

TRAFFIC SIMULATION BOARD GAME APPARATUS

BACKGROUND OF THE INVENTION

The field of invention relates to game apparatus, and more particularly pertains to a new and improved traffic simulation board game apparatus wherein the same effects simulation of traffic hazards and interaction to simulate conventional traffic patterns.

2. Description of the Prior Art

The use of various games to simulate life experiences and games that have been utilized to simulate board games have been available in the prior art. The instant invention attempts to set forth a board game apparatus to enhance enjoyment and excitement in a simulation of traffic patterns encountered by vehicular travel along highway paths. Examples of the prior art include U.S. Pat. No. 4,067,579 to Boofer setting forth a board game defined by a map and a plurality of terminals with map defining routes for opposing players to traverse.

U.S. Pat. No. 4,087,094 to Bakay sets forth a traffic pattern game with spaces to create illusion of speed, as well as utilizing destination and hazard cards randomly selected during play of the game.

U.S. Pat. No. 4,054,289 to Burkett sets forth a board game to simulate traffic flow, with streets intersecting one another at right angles thereto to provide opposing players of knowledge of traffic patterns.

U.S. Pat. No. 4,426,084 to Michel sets forth a trucking simulation game to simulate traverse of a truck along a route.

U.S. Pat. No. 4,375,889 to Burkett sets forth a traffic board game setting forth a further pattern of streets and the like for providing knowledge of traffic patterns to players.

As such, it may be appreciated that there continues to be a need for a new and improved traffic simulation board game apparatus set forth by the instant invention which addresses both the problems of ease of use as well as effectiveness in construction in cooperatively associating a timer, a sequencing device, and players directed to traverse paths of game utilizing the sequencing device in association with the timer.

SUMMARY OF THE INVENTION

In view of the foregoing disadvantages inherent in the known types of traffic pattern board games now present in the prior art, the present invention provides a traffic simulation board game apparatus wherein the same utilizes time and random selection of play to impart knowledge of traffic patterns and provide amusement and entertainment in play of the game. As such, the general purpose of the present invention, which will be described subsequently in greater detail, is to provide a new and improved traffic simulation board game apparatus which has all the advantages of the prior art traffic simulation board games and none of the disadvantages.

To attain this, the present invention provides an apparatus including a game board with a lattice-work of intersecting highway paths, with the highway paths including intersecting portions defined by an intersection of each of the paths, wherein the intersection portions include off and on ramps, where each of the highway paths include a spaced plurality of apertured pathways to receive dowels from associated player tokens. The tokens are directed to proceed along the apertured pathways by a directional controlling unit. The directional controlling unit includes sequentially and randomly illustrated light members to indicate whether a player token is to proceed. Each player must culminate movement within a time frame by an associated time clock, with game cards and dice utilized to create obstacles and assess penalties and damages and the like upon players who create accidents or other mistakes of judgment resulting in a lack of progress during a predetermined time interval.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved traffic simulation board game apparatus which has all the advantages of the prior art traffic simulation board games and none of the disadvantages.

It is another object of the present invention to provide a new and improved traffic simulation board game apparatus which may be easily and efficiently manufactured and marketed.

It is a further object of the present invention to provide a new and improved traffic simulation board game apparatus which is of a durable and reliable construction.

An even further object of the present invention is to provide a new and improved traffic simulation board game apparatus which is susceptible of a low cost of manufacture with regard to both materials and labor, and which accordingly is then susceptible of low prices of sale to the consuming public, thereby making such traffic simulation board game apparatus economically available to the buying public.

Still yet another object of the present invention is to provide a new and improved traffic simulation board game apparatus which provides in the apparatuses and methods of the prior art some of the advantages thereof, while simultaneously overcoming some of the disadvantages normally associated therewith.

Still another object of the present invention is to provide a new and improved traffic simulation board game apparatus wherein the same incorporates a timing device and random directional organization to effect directing of a player about highway paths on the board game.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
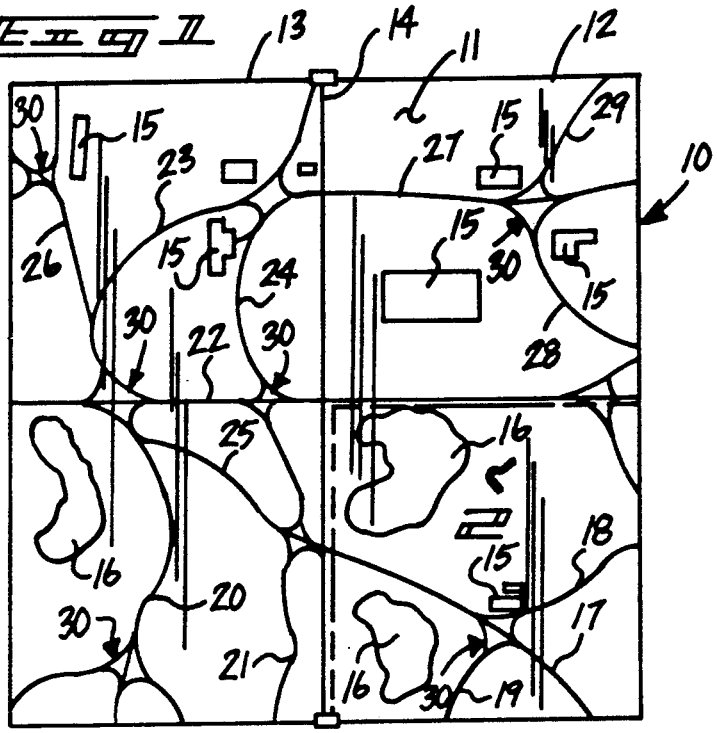
FIG. 1 is an orthographic top view of the board game of the instant invention.

With reference now to the drawings, and in particular to FIGS. 1 to 7 thereof, a new and improved traffic simulation board game apparatus embodying the principles and concepts of the present invention and generally designated by the reference numeral 10 will be described.

Figure 2:
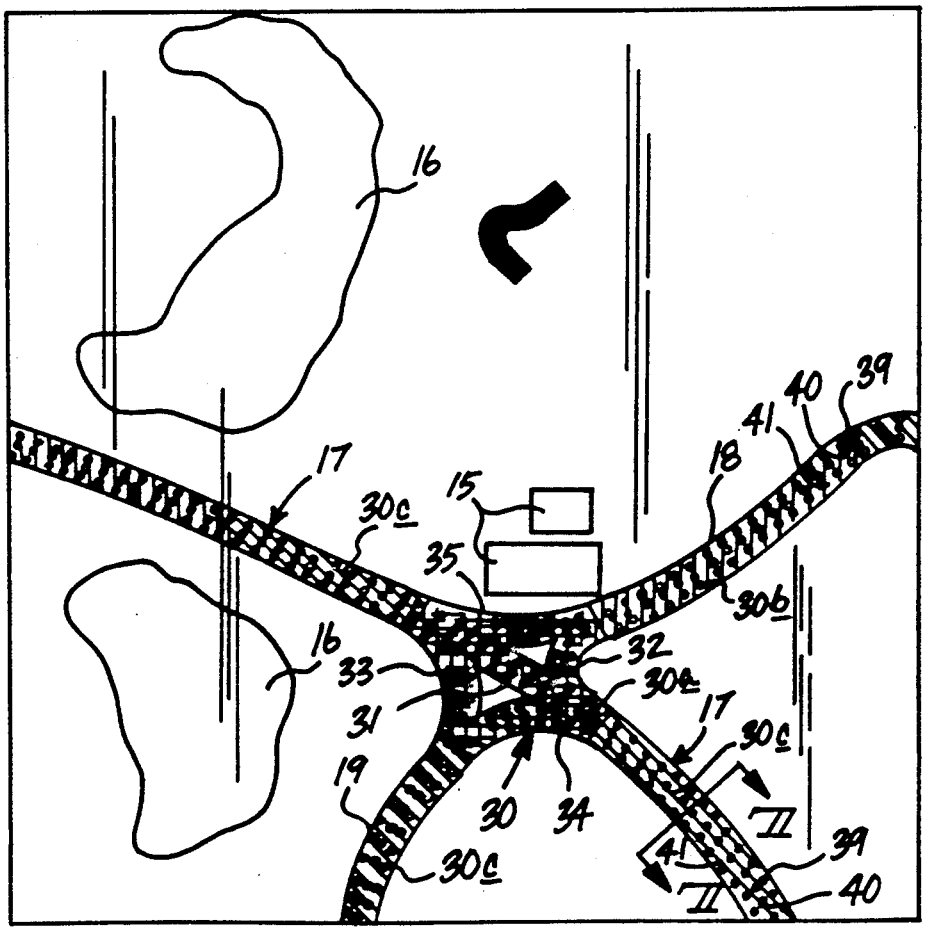
FIG. 2 is an orthographic top view, somewhat enlarged, of section 2, as illustrated in FIG. 1.
Figure 3:
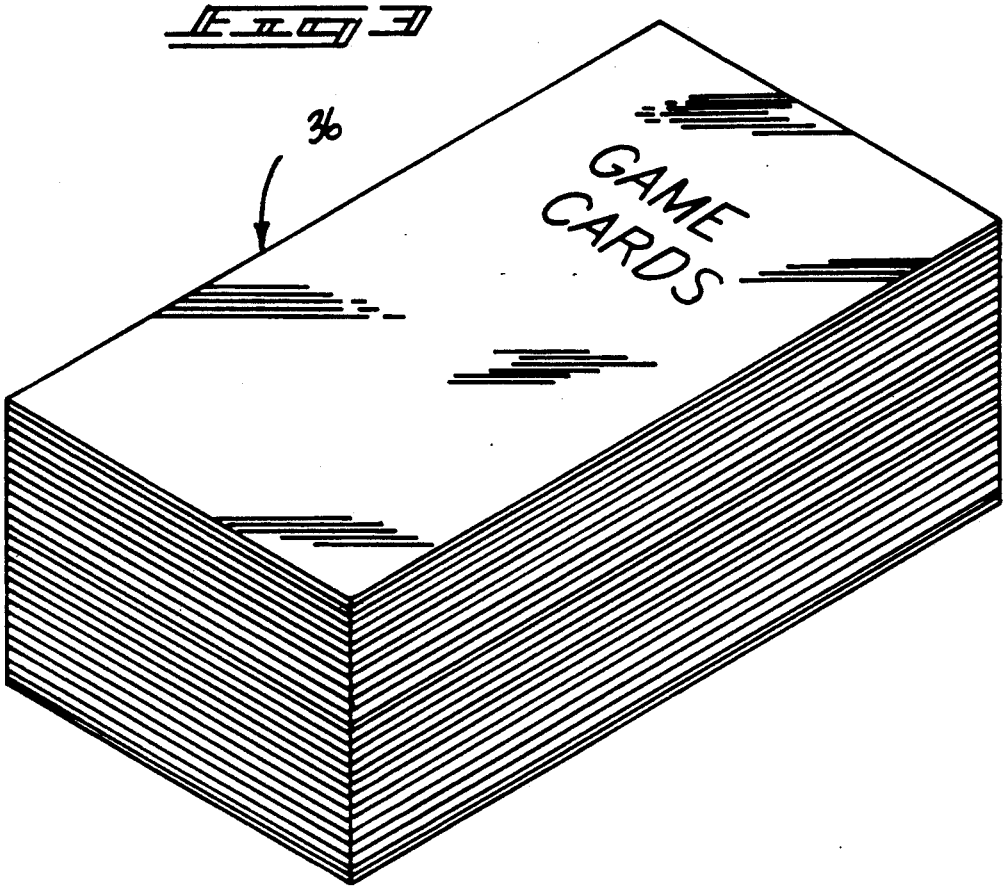
FIG. 3 is an isometric illustration of the game cards utilized by the instant invention.

More specifically, the traffic simulation board game apparatus 10 of the instant invention essentially comprises a playing board defined by a planar top playing surface 11 formed by a union of a first board member 12 and a second board member 13 joined longitudinally of one another by an elongate fastener member 14 to define the continuous planar top playing surface 11. The playing surface has imparted thereon a simulation of building characterizations 15, bodies of water 16, and a plurality of path segments defined by a first path segment 17, a second path segment 18, a third path segment 19, a fourth path segment 20, a fifth path segment 21, a sixth path segment 22, a seventh path segment 23, an eighth path segment 24, a ninth path segment 25, a tenth path segment 26, an eleventh path segment 27, a twelfth path segment 28, and a thirteenth path segment 29 originating from opposed corners of the board, wherein opposing players may initiate play from a preselected corner and direct play to an opposing corner at a desired path of travel. The various path segments intersect at diamond shaped intersections 30. A typical intersection is illustrated in FIG. 2, wherein a main or first path segment 17 intersects a second and third path segment 18 and 19 respectively. The main path segment 17 includes a continuing intersection path 31 directed through the diamond shaped intersection dividing the second and third path segments 18 and 19. The continuing intersection path includes a respective first and second exit path 32 and 33 defining opposed sides of the diamond shaped intersection, with a first and second entrance path 34 and 35 providing access to the main or first path segment 17 defining the opposed pairs of the diamond shaped intersection to permit access to the first path segment 17 by the second and third path segments 18 and 19 respectively. Each of the path segments includes a first, second, and third apertured pathway 39, 40, and 41 respectively. The apertured pathways define a series of equally spaced aligned bores (see FIG. 7 for example) to receive a token automotive configuration 42 therewithin, wherein each token 42 includes a dowel 43 orthogonally and integrally from a bottom surface thereof for reception within a respective aperture of the apertured pathway.

Figure 4:
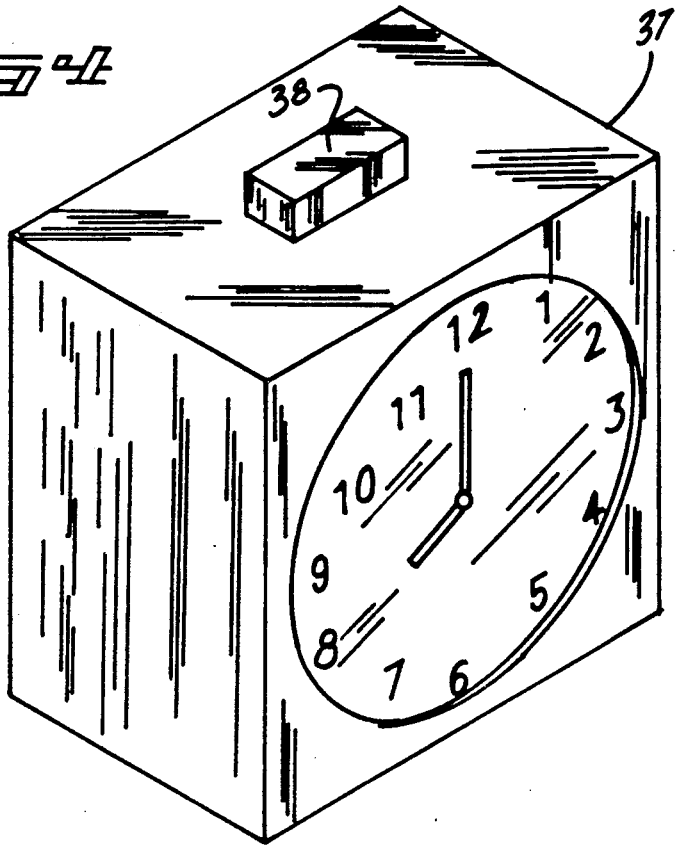
FIG. 4 is an isometric illustration of a timing device utilized by the instant invention.

A timer mechanism 37 is utilized, as illustrated in FIG. 4, with a start button 38 to initiate a predetermined time interval afforded each player during alternating turns of each player.

Figure 5:
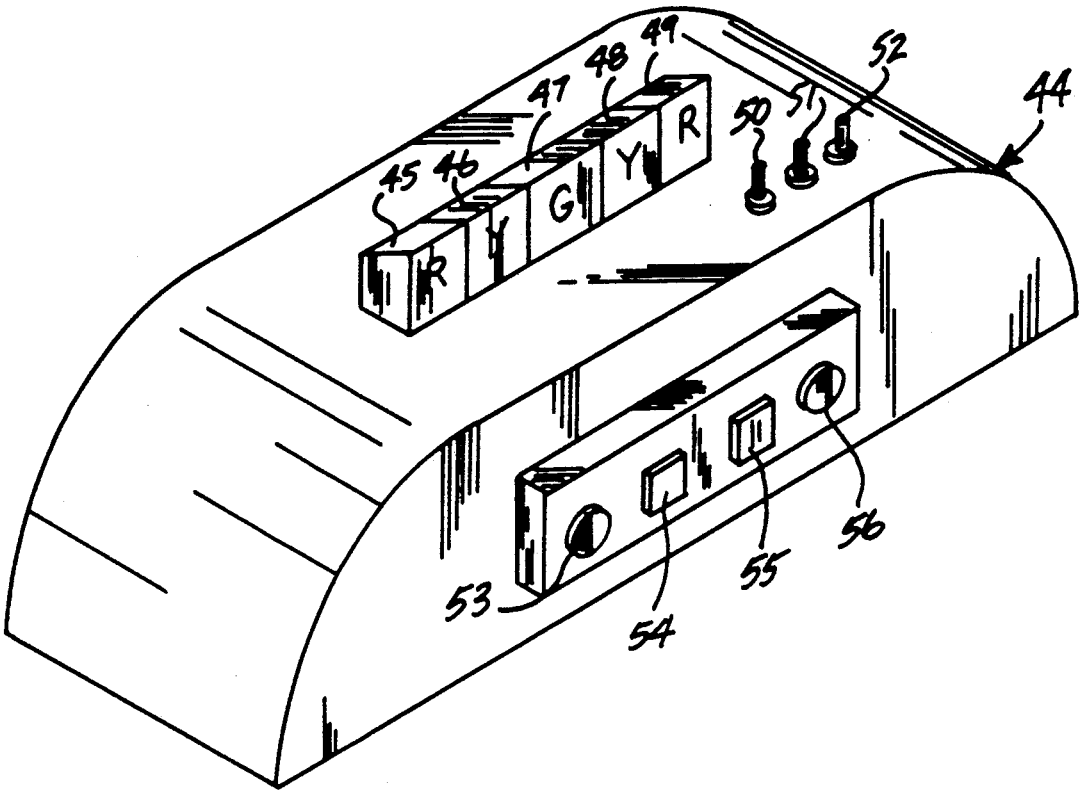
FIG. 5 is an isometric illustration of the directional controller unit utilized by the instant invention.
Figure 8B:
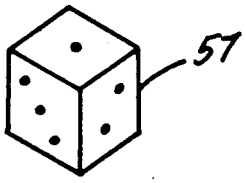
FIG. 8 is an isometric illustration of a six-sided die utilized by the instant invention.
Figure 6:
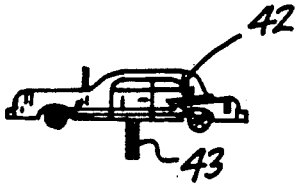
FIG. 6 is an orthographic side view, taken in elevation, of a typical token utilized by the instant invention.
Figure 7:
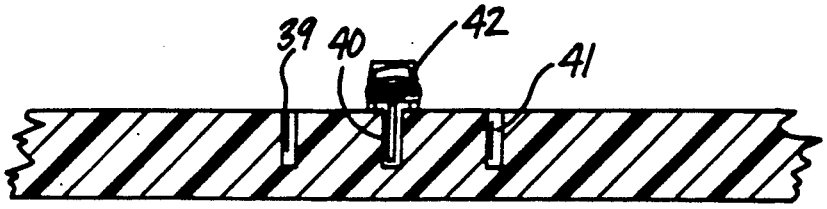
FIG. 7 is an orthographic view, taken along the lines 7—7 of FIG. 2, in the direction indicated by the arrows.

A random selection directional controller unit 44 is provided, as illustrated in FIG. 5. The controller unit utilizes conventional battery power and circuitry of available circuitry to effect random illumination of a respective first, second, third, fourth, and fifth respective indicator light. The first and fifth indicator lights are defined by a first indicator coloration, with the second and fourth indicator lights of a second indicator coloration, with the third indicator light or medial indicator light of a third coloration. The first coloration, typically of a red coloration, indicates that a player must stop ending that player's turn or progress in that particular direction, wherein the second indicator coloration indicates a player may proceed but with caution as the first indicator coloration is eminent, and wherein the second coloration is typically of a yellow coloration. The red light may be used merely to indicate that a player cannot proceed in the chosen direction thereby allowing a player to choose an alternative direction and continue to move. The third coloration of the third indicator light is of typically a green coloration to permit a player continue his turn by having another chance to actuate the directional controller unit, thereby giving the player a chance at subsequently moving his token. The players move their tokens one aperture along the pathway after each actuation of the directional controller unit. A top card of the directional cards 36 is selected when a player lands on a marked aperture. The player must then overcome the obstacle presented by the card or record any assessed damages or penalties. A player may not move the token after the allotted time. Also, upon receiving a first indicator coloration after each attempt to proceed, the player must stop and record the elapsed time.

The directional controller unit 44 further includes a first, second, and third coloration switch 50, 51, and 52, wherein the switches correspond to one of a first, second, and third coloration on the path segments, as indicated in FIG. 2, by a first coloration 30*a* at each intersection, a second coloration 30*b* at intersecting pathways 18 and 19, and a third coloration 30*c* along the main or first path segment 17 that defines the continuous intersecting path 31 through each intersection. A front panel of the directional controller unit 44 includes a first, second, third, and fourth button member 53, 54, 55, and 56. The first button member 53 includes a go mode of the organization. The second button member 54 defines a stop mode of the organization. The third button member 55 defines a right lane change, and the fourth button member 56 defines a left lane change as a player proceeds along one of the path segments 17.

During each player's turn, the player first starts the clock by depressing button 38. The player begins moving his token by actuating the colored switch 50, 51 or 52 which corresponds to the coloration 30*a*, 30*b*, or 30*c* his token is located on. The actuation of the switch illuminates all the indicator lights 45–49 respectively in alternating sequences. After this switch is actuated, the player selects one of the buttons 53, 54, 55 or 56 and actuates it. The actuation of the button stops the alternating sequences of illuminating lights and randomly illuminates only one light. This light indicates whether the player can move his token one aperture and continue his turn, or whether the player's turn is ended. For example, if a switch 50, 51 or 52 has already been actuated and the player decides that he wants to move his token directly forward, he actuates the first button 53. If the third or green light 47 is randomly selected, his token is moved forward one aperture and the player's turn continues by again actuating a corresponding switch and selecting a button. If on the next turn, the player decides that he wants to make a left lane change, the player actuates the fourth button 56. If the green light 47 is randomly selected, his token moves one aperture to the left and the player's turn continues by again actuating the corresponding switch. As a player moves from one of the first through third coloration portions of each path segment, the player must in turn effect actuation of the corresponding first, second or third coloration switches 5, 51, or 52. Once a button is actuated and a red light 45 or 49 is randomly selected the players turn is over and the player stops clock by again depressing the button 38 and records elapsed time. The player cannot stop the clock during either green or yellow colorations. The number of apertures a player can pass through depends upon the time utilized by the player, by the timer mechanism 37, and concentration. Once a player's turn is over, the next player is given a turn to move his token. A winner is awarded upon a player reaching a predetermined off-ramp, such as an off-ramp 32 or 33 of the intersection 30, as set forth in FIG. 2, in the least amount of time, including any penalty time incurred during the course of the game.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the U.S. is as follows:

1. A traffic simulation board game apparatus simulating travel upon highway paths, wherein the apparatus comprises, a board member including a planar top playing surface, the board member including a first board member and a second board member, including a fastener member to align the first board member and second board member together, and a plurality of sequitous path segments directed about the top playing surface, with each of the path segments intersecting at a predetermined number of intersections, the intersections defined by a first coloration, and the path segments defined by second and third colorations dispersed about the path segments, and a plurality of tokens for movement on said path segments, and directional controller unit for determining the movement of said tokens, said directional controller unit including a series of indicator lights operatively associated with a first, second, and third coloration switches, wherein the actuation of any one of said switches illuminates all of said indicator lights in an alternating sequence, said first, second, and third coloration switches are color coded to correspond to the first, second, and third coloration about the path segments, and said directional controller unit having mounted thereon a plurality of buttons, each button representing an instruction for movement, said buttons comprising a first go button, a second stop button, a third right lane change button, and a fourth left lane change button, wherein the actuation of any one of said buttons stops the alternating sequence of illuminating lights and randomly illuminates only one of said lights indicating whether or not the instruction represented on said actuated button is to be followed.

2. An apparatus as set forth in claim 1 further including a timer, wherein the timer includes a start/stop button to indicate an elapse of time from a predetermined quantity of time afforded each player at the outset of play of the apparatus.

3. An apparatus as set forth in claim 2 wherein each of the path segments includes a plurality of parallel apertured pathways, each of the pathways including equally spaced bores directed therethrough, and each player afforded one of said tokens with each token including a dowel, with each dowel integrally and orthogonally mounted to a bottom surface of each token, with the dowel complementarily receivable within a bore of each of the apertured pathways.

4. An apparatus as set forth in claim 3 wherein each of the first, second, and third coloration switches is selectively actuated by a player by a token being positioned upon a respective first, second, or third coloration upon a path segment of the plurality of path segments to effect alternating sequencing of the indicator lights.

* * * * *